US005575063A

United States Patent [19]

Hodan et al.

[11] Patent Number: 5,575,063

[45] Date of Patent: Nov. 19, 1996

[54] MELT-SPINNING SYNTHETIC POLYMERIC FIBERS

[75] Inventors: John A. Hodan, Arden; Otto M. Ilg, Asheville, both of N.C.

[73] Assignee: BASF Corporation, Parsippany, N.J.

[21] Appl. No.: 447,516

[22] Filed: May 23, 1995

Related U.S. Application Data

[62] Division of Ser. No. 138,907, Oct. 18, 1993, Pat. No. 5,533,833, which is a continuation of Ser. No. 968,557, Oct. 29, 1992, abandoned.

[51] Int. Cl.[6] ..... B23P 15/00

[52] U.S. Cl. ..... 29/890.09; 29/557

[58] Field of Search ..... 29/890.09, 428, 29/557; 264/171; 425/131.5, DIG. 217, 463, 192.5, 382.2, 198

[56] References Cited

U.S. PATENT DOCUMENTS

| | | | |
|---|---|---|---|
| 2,517,711 | 8/1950 | Pool et al. | 18/8 |
| 3,050,774 | 8/1962 | Tait | 425/463 |
| 3,192,562 | 7/1965 | Powell | 18/8 |
| 3,204,290 | 9/1965 | Crompton | 18/8 |
| 3,245,113 | 4/1966 | Sulich | 18/8 |
| 3,467,124 | 9/1969 | Simson | 29/890.09 |
| 3,488,806 | 1/1970 | De Cecco et al. . | |
| 3,501,805 | 3/1970 | Douglas et al. | 18/8 |
| 3,613,170 | 10/1971 | Soda et al. | 18/85 C |
| 3,704,971 | 12/1972 | Baird et al. | 425/131 |
| 3,762,850 | 10/1973 | Werner et al. | 425/198 |
| 3,777,344 | 12/1973 | Glass | 29/890.09 |
| 3,787,162 | 1/1974 | Cheetham | 425/463 |
| 3,807,917 | 8/1974 | Shimoda et al. | 425/131 |
| 4,072,457 | 2/1978 | Cooksey et al. | 425/192 |
| 4,439,487 | 3/1984 | Jennings | 428/397 |
| 4,593,446 | 6/1986 | Hayner | 29/890.09 |
| 5,162,074 | 11/1992 | Hills | 156/644 |
| 5,227,109 | 7/1993 | Allen et al. | 264/171 |
| 5,344,297 | 9/1994 | Hills | 452/DIG. 217 |

FOREIGN PATENT DOCUMENTS

| | | | |
|---|---|---|---|
| 2429274 | 1/1980 | France . | |
| 47-15529 | 5/1972 | Japan | 125/131.5 |
| 1335579A | 4/1986 | U.S.S.R. . | |
| 1381865 | 1/1975 | United Kingdom . | |
| WO89/02938 | 4/1989 | WIPO . | |

*Primary Examiner*—Irene Cuda

[57] ABSTRACT

A spin pack for spinning synthetic fibers from two or more liquid polymer streams includes a supply for at least two polymer streams to the spin pack; a spinneret having extrusion orifices; and flow distribution plate sets. The flow distribution plate sets include at least one patterned plate having edges which define a substantially regular two-dimensional geometric shape, a substantially planar upstream surface, a substantially planar downstream surface and at least one flow distribution pattern stenciled therein by cutting through. For each patterned plate, at least one boundary plate stacked sealingly adjacent thereto and having edges which define a substantially regular geometric shape, a substantially planar upstream surface and a substantially planar downstream surface. The boundary plate has cut-through holes connecting the upstream surface with the downstream surface to form at least one flow-through channel to allow fluid flow through the patterned plate but otherwise is substantially solid.

4 Claims, 3 Drawing Sheets

MELT-SPINNING SYNTHETIC POLYMERIC FIBERS

This is a divisional of application(s) Ser. No. 08/138,907, filed on Oct. 18, 1993, now U.S. Pat. No. 5,533,833 which was a FWC of Ser. No. 07/968,557, filed on Oct. 29, 1992, (now abandoned).

FIELD OF THE INVENTION

The present invention relates generally to melt spinning synthetic polymeric fibers. More particularly, the present invention relates to apparatus for distributing molten polymer flow to the backhole of a spinneret.

BACKGROUND OF THE INVENTION

As used herein, the term "regular geometric shape" refers to the common two-dimensional shapes of a rectangle, square, oval, circle, triangle or other similar ordinary shape.

Thin distribution flow plates having complex distribution flow patterns formed on one surface thereof accompanied by through holes are known. Distribution flow plates of that type improve flexibility and melt flow processing when compared to the state of the art at the time of that invention. Such plates are disclosed in co-owned U.S. Pat. No. 5,162,074 issued Nov. 10, 1992, "Profiled Multi-Component Fibers and Method and Apparatus for Making Same".

Although thin distribution flow plates having complex flow patterns provide many advantages, additional advantages are available when the multiple functions of these thin plates are split up so that only a single function is performed in a single thin plate. This allows mixing and matching of functions by interchanging only one or more of the single function plates within a stack of plates. For example, by changing one or more of the single function plates, the resulting fiber's cross-section can be changed from sheath/core to side-by-side without modification of the other spin pack parts.

French Patent No. 2,429,274 discloses a stack of thin plates useable to combine distinct polymer streams prior to the backhole of a spinneret. Each backhole requires its own stack of plates although the stacks may be interconnected. Because they result in polymer stream mixing, these plates are unsuitable for forming many cross-sections, for example, sheath core.

SUMMARY OF THE INVENTION

Accordingly, the present invention is a spin pack for spinning synthetic fibers from two or more liquid polymer streams including means for supplying at least two polymer streams to the spin pack, a spinneret having extrusion orifices and flow distribution plate sets. The flow distribution plate sets include at least one patterned plate having edges which define a substantially regular two-dimensional geometric shape, a substantially planar upstream surface, a substantially planar downstream surface and at least one flow distribution pattern stenciled therein by cutting through. The flow distribution pattern connects the upstream surface with the downstream surface. The flow distribution plate sets further include, for each patterned plate, at least one boundary plate stacked sealingly adjacent thereto and having edges which define a substantially regular geometric shape, a substantially planar upstream surface and a substantially planar downstream surface. The boundary plate has cut-through holes connecting the upstream surface with the downstream surface to form at least one flow-through channel to allow fluid flow through the patterned plate and otherwise is substantially solid with solid portions where the patterned plate is cut through to accomplish fluid flow in a direction transverse to the flow in the flow-through channel. The liquid polymer streams flow as discrete streams through the flow distribution plate sets to the spinneret.

Another aspect of the present invention is a process for spinning fibers from synthetic polymers (a) feeding at least one liquid polymer to a spin pack; and (b) in the spin pack, routing the at least one polymer to at least one patterned plate having edges defining a substantially regular two-dimensional geometric shape, a substantially planar upstream surface, a substantially planar downstream surface and at least one flow distribution pattern stenciled therein by cutting through. The flow distribution pattern connects the upstream surface with the downstream surface. Each patterned plate has at least one corresponding boundary plate stacked sealingly adjacent thereto and has edges which define a substantially regular geometric shape, a substantially planar upstream surface and a substantially planar downstream surface. The boundary plate has cut-through holes connecting the upstream surface with the downstream surface to form at least one flow-through channel to allow fluid flow through the patterned plate and otherwise is substantially solid with solid portions where the patterned plate is cut through to accomplish fluid flow in a direction transverse to the flow in the flow-through channel. The liquid polymer streams flow as discrete streams through flow distribution channels formed by the at least one patterned plate and the at least one corresponding boundary plate to the spinneret. The polymer is extruded into fibrous strands.

A still further aspect of the present invention is a method of assembling a flow distribution plate for distributing at least two discreet molten polymer streams to a spinneret comprising: (a) stenciling a pattern in at least one first plate such that the first plate has edges which define a substantially regular two-dimensional geometric shape, a substantially planar upstream surface, a substantially planar downstream surface and at least one flow distribution pattern stenciled therein by cutting through. The flow distribution pattern connects the upstream surface with the downstream surface. The first plate is then stacked sealingly adjacent to a second plate which has edges which define a substantially regular geometric shape, a substantially planar upstream surface and a substantially planar downstream surface. The boundary plate has cut-through holes connecting the upstream surface with the downstream surface to form at least one flow-through channel to allow fluid flow through the patterned plate and otherwise is substantially solid with solid portions where the patterned plate is cut through to accomplish fluid flow in a direction transverse to the flow in the flow-through channel. The liquid polymer streams flow as discrete streams through the flow distribution plate sets to the spinneret.

It is an object of the present invention to provide a versatile flow distribution apparatus for melt spinning synthetic fibers.

Another object of the present invention is a versatile process for melt spinning synthetic fibers.

A further object of the present invention is to provide a method for assembling distribution flow apparatus.

Related objects and advantages will be apparent to those ordinarily skilled in the art after reading the following detailed description.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

The present invention involves thin plates having polymer flow holes and channels cut through them. These plates have substantially planar upstream and downstream surfaces that form substantially regular geometric shapes. A stack of two or more of these plates can be used in forming multicomponent fibers or mixed component yarns having various cross-sections. These plates are inexpensive and disposable, and have a high degree of design flexibility. The flow holes and channels may be cut through using electro-discharge machining (EDM), drilling, cutting (including laser cutting) or stamping. Preferable machining techniques are those which allow for a wide selection of plate materials so long as the materials do not creep under the spinning conditions and do not adversely react with the polymers. Possible materials include both ferrous and non-ferrous metals, ceramics and high temperature thermoplastics. The high temperature thermoplastics can even be injection molded. While methods for machining, eroding, stamping, injecting, etc., are readily available in the art, for convenience, an example of how a plate may be made is provided in Example 1.

The thin distribution flow plate sets of the present invention include pattern plates and boundary plates. Unlike other comparable thin distribution plates, the disclosed pattern plates have transverse channels cut completely through from the upstream surface to the downstream surface. The surface of the next adjacent downstream plate serves as the bottom or boundary of the flow channel. Therefore, each thin plate contains only one feature, i.e., arrangement of channels and holes to distribute melt flow in a predetermined manner. Greater flexibility relative to other more complicated flow distribution plates is provided.

Figure 1:
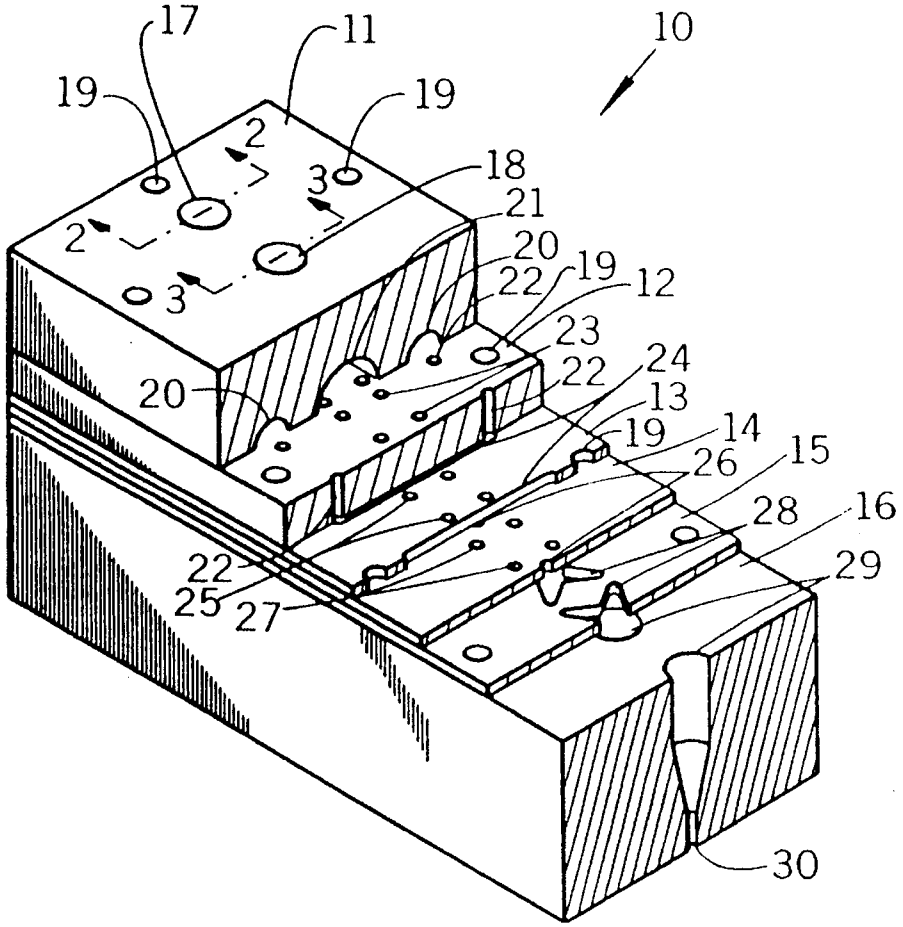
FIG. 1 is a cut-away perspective view of a spin pack assembly for making sheath/core type fibers and incorporating flow distribution plate sets of the present invention.

Referring to FIG. 1, a spin pack assembly constructed in accordance with the present invention and designed to produce sheath/core bicomponent fibers of round cross section is illustrated. Assembly 10 includes the following plates sealingly adjoining each other: polymer inlet block 11; metering plate 12; first pattern plate 13; boundary plate 14; second pattern plate 15 and spinneret plate 16. Fluid flow is from inlet block 11 to spinneret plate 16. The parts of the assembly may be bolted together and to the spinning equipment by means of bolt holes 19. Polymer inlet block 11 includes holes for receiving each type of polymer being extruded. In this example there are two polymers, sheath and core, so that two polymer inlet orifices 17 and 18 are shown.

Figure 2:
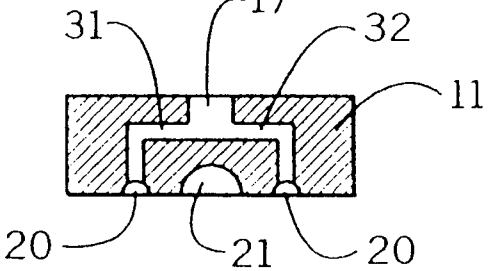
FIG. 2 is an elevational cross-sectional view of the polymer inlet of FIG. 1 taken along line 2—2 and looking in the direction of the arrows.

Downstream of polymer inlet block 11 is metering plate 12 which contains metering holes 22 and 23 which receive polymer from core channels 20 and sheath channel 21, respectively. Metering holes 22 receive core polymer from distribution channels 20 (FIG. 2) and route it to distribution slot 24 cut-through first pattern plate 13. Metering holes 23 receive polymer from sheath distribution channel 21 (FIG. 2) and convey it to holes 25 cut through first pattern plate 13 and to holes 27 cut through boundary plate 14 which sealingly adjoins first pattern plate 13.

The top surface of boundary plate 14 confines the core polymer within cut channel 24 whereby the core polymer fills channel 24 and is forced to exit through cut hole 26 in boundary plate 14. Boundary plate 14 has a regular two-dimensional shape, i.e., a rectangle.

Pattern plate 15 has a regular two-dimensional shape, i.e., a rectangle, and has star shaped holes cut through its thickness. The center of the star aligns with the center of backhole 29 of spinning orifice 30 in spinneret plate 16. The four corners of star holes 28 are located outside the perimeter of backhole 29. Sheath polymer streams from holes 27 in boundary plate 14 flow into the corners of star holes 28. Because the bottom surface of boundary plate 14 confines the streams to star holes 28, the sheath streams flow laterally into the backhole 29. Therefore, boundary plate 14 forms the lower boundary for channel 24 and the upper boundary for star hole 28. The core polymer stream from hole 26 of plate 14 flows into the center of star hole 28 and down into backhole 29 where it is surrounded by sheath streams. The combined flow issues from spinning orifices 30 to form round bicomponent fibers.

Figure 3:
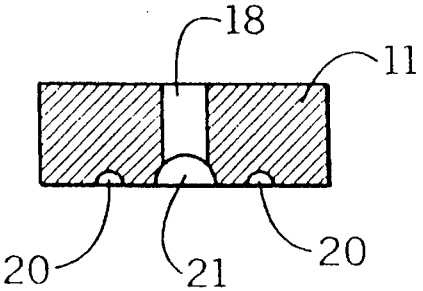
FIG. 3 is an elevational cross-sectional view of the polymer inlet block of FIG. 1 taken along line 3—3 in FIG. 1.

As will be recognized by the ordinarily skilled, molten polymers may be fed to the assembly by any suitable conventional means. Molten core polymer enters the assembly through polymer inlet 17 shown in the elevational cross-section of FIG. 2. Inlet 17 splits into feed legs 31 and 32 which feed the two main distribution channels 20. Molten sheath polymer enters through inlet 18 shown in the elevational cross-section of FIG. 3 and flows to main distribution channel 21.

Figure 7:
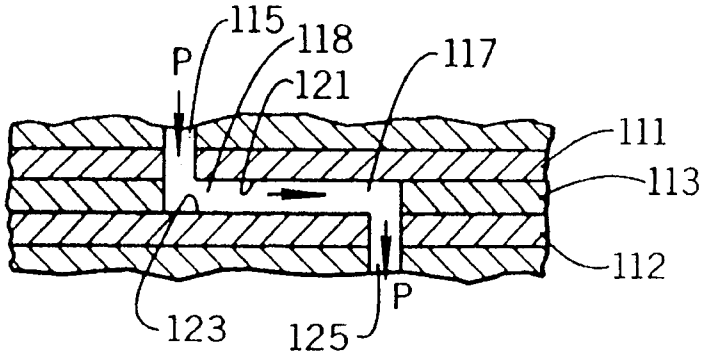
FIG. 7 is a partial cross-sectional view of three stacked plates according to the present invention.

FIG. 7 further illustrates the general principle of the present invention. Shown in FIG. 7 are three plates of a spin pack in partial cross-section. These plates illustrate the boundary/pattern plate concept. As shown, plates 111 and 112 are boundary plates and plate 113 is a pattern plate. Polymer flow is in the direction of arrows P. Polymer passes through the cut-through portion (through hole 115) because through hole 115 overlaps pattern 117 in plate 113. Pattern 117 allows transverse flow of the polymer, i.e., transverse to the polymer flow in the through hole 115, of the polymer because a horizontal flow channel 118 is formed by the faces 121 and 123 of boundary plates 111 and 112, respectively. The horizontal flow path directs the polymer to through hole 125 because hole 125 overlaps with pattern 117.

Figure 8:
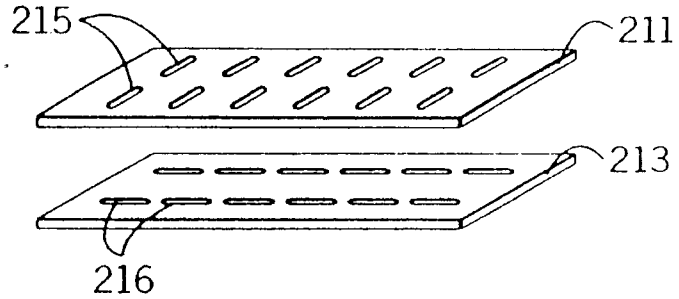
FIG. 8 is an exploded view of two plates from a spin pack showing an alternate configuration of the present invention.

It will be readily apparent to those who are ordinarily skilled in this art that the shape of the pattern and boundary holes may vary widely so long as any portion of the cut-through parts on adjacent plates overlap. Also, certain plates may perform both boundary and pattern functions. This concept is illustrated in FIG. 8. FIG. 8 shows in exploded partial elevational perspective view of dual function plates 211 and 213. Upper dual function plate 211 has elongated slots 215 cut through its thickness.

Lower dual function plate 213 also has elongated slots 216 cut through its thickness. Immediately adjacent slots 215 and 216 overlap so that they are in fluid flow communication. Yet, these slots are oriented at 90° relative to each other so that polymer passing from slot 215 into slot 216 will change its course by 90°.

Figure 9:
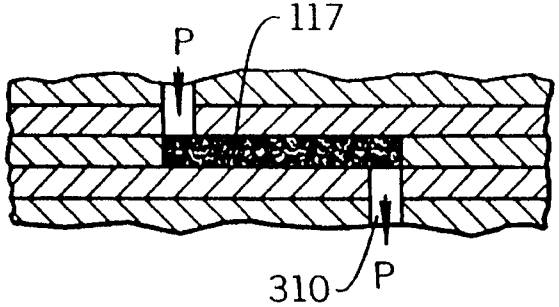
FIG. 9 is the partial cross-sectional view of FIG. 7, showing an optional filtering insert.

Optionally, filtering parts may be incorporated into the apparatus. For example, porous metal inserts may be placed within the cut of a pattern plate. As shown in FIG. 9, porous metal insert 310 has the dimensions of cut (pattern) 117 in plate 113. Polymer flow (P) passing through porous metal insert 310 will be filtered.

Figure 10:
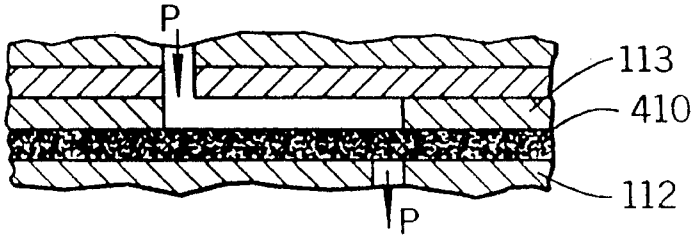
FIG. 10 is a partial cross-section similar to FIG. 7 but showing an alternate optional filtering insert.

An alternative method for filtering is shown in FIG. 10. Porous plate 410 is inserted between pattern plate 113 and boundary plate 112. Polymer flow (P) passing through porous plate 410 will be filtered.

Also envisioned as part of the present invention is a process for spinning polymers. Preferably, the process is for melt spinning molten thermoplastic polymers. An apparatus of the present invention is useful in the process of the present invention. In the process, one or more molten polymer streams, preferably at least two, enter a spin pack. In the spin pack, the polymers are distributed as discrete streams from the inlet to the backhole of a spinneret where they may or may not meet, depending on the particular cross-section being extruded. Distribution is accomplished by routing the polymer through holes and into channels where the channels are bounded by at least the plate immediately above or below. Alternatively, the channels are bounded by both the plates above and below.

In the channels, the polymer flows transversely (or perpendicular) to the flow in the holes. Eventually, the polymer exits the channel through another hole in the plate immediately below.

The apparatus and process of the present invention are useful for melt spinning thermoplastic polymers according to known or to be developed conditions, e.g., temperature, denier, speed, etc., for any melt spinnable polymer. Post extrusion treatment of the fibers may also be according to standard procedures. The resulting fibers are suitable for use as expected for fibers of the type.

The invention will be described by reference to the following detailed example. The example is set forth by way of illustration, and is not intended to limit the scope of the invention.

EXAMPLE 1

EDM Plates

The x-y coordinates of 24 circular holes and 6 oblong holes are programmed into a numerically controlled EDM machine supplied by Schiess Nassovir with a 0.096 micron spark width correction (offset).

A 0.5 mm thick stainless steel plate is sandwiched between two 2 mm thick support plates and fastened into the frame opening of the EDM machine with help of three clamps. A 0.5 mm diameter hole is drilled into the center of each hole and channel to be eroded and a 0.15 mm brass wire electrode is threaded through the hole. The wire is properly tensioned. The cutting voltage is 70 volts. The table with the plate assembly is guided by means of the computerized x-y guidance program to achieve the desired pattern after the power has been turned on. While cutting, the brass wire electrode is forwarded at a rate of 8 mm/sec and the plate assembly advances at a cutting rate of 3.7 mm/min. Throughout the cutting, the brass wire electrode is flushed with demineralized water with a conductivity of 2×10 E4 Ohm cm with a nozzle pressure of 0.5 kg/cm$^2$. After the desired pattern has been cut, the support plates are discarded.

EXAMPLE 2

Spinning Fibers

Figure 6:
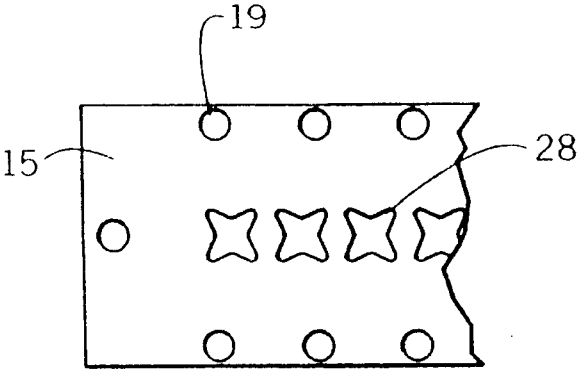
FIG. 6 is the top plan view of a pattern plate of FIG. 1 according to the present invention.
Figure 4:
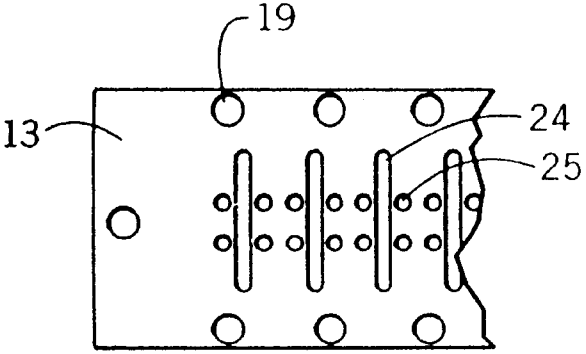
FIG. 4 is the top plan view of a dual-function pattern and boundary plate of FIG. 1 according to the present invention.
Figure 5:
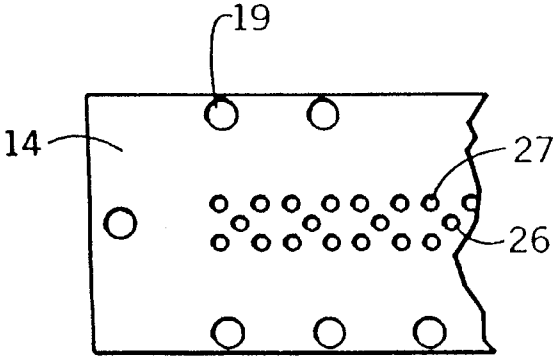
FIG. 5 is the top plan view of a boundary plate of FIG. 1 according to the present invention.

Thin distribution plates having cuts similar to the plates shown in FIGS. 4, 5 and 6 are machined from 26 gauge (0.018") 430 stainless steel. The plates are inserted between a reusable spinneret and a metering plate. A top plate having polymer inlets is located upstream of the metering plate. The top plate, metering plate, thin distribution plates and spinneret are cylindrical in shape. These plates are positioned into a spinneret housing with through bolts which provide a clamping force to seal the surfaces of the plates.

The sheath polymer is nylon 6 having an RV of approximately 2.4. The temperature of the molten sheath polymer is controlled at 278° C. The core polymer is nylon 6 having an RV of approximately 2.7. The temperature of the molten core polymer is controlled at 288° C. The spin pack and spinneret are controlled at 285° C. Each spinneret has two groups of three capillaries having a diameter of 200 microns and a length of 400 microns.

The fibers are quenched as they exit the spinneret by a stream of cross flowing air having a velocity of approximately 30 m/min. The yarns make an "S" shaped path across a pair of godets before being wound onto a bobbin. The surface velocities of the first and second godets is 1050 and 1054 m/min respectively. The yarn has a velocity of 1058 m/min at the winder. A water-based finish dispersion is applied to the yarns prior to winding.

Three filament 50 denier yarn is spun from the plate assembly. Each filament is a round, concentric, sheath/core bicomponent having a core which makes up 10% of the total fiber cross-sectional area. The resulting sheath/core yarns have good physical properties as demonstrated from the following table.

TABLE

| | Denier | Breaking Load (g) | Tenacity (g/den) | Elongation at 1% (%) | Modulus at 10% (g/den) | Modulus (g/den) |
|---|---|---|---|---|---|---|
| Avg. | 49.6 | 58.67 | 1.18 | 413.89 | 3.41 | 2.63 |
| Std. Dev. | 0.02 | 2.27 | 0.05 | 15.65 | 2.78 | 0.11 |

What is claimed is:

1. A method of assembling a flow distribution plate set for distributing at least two discreet molten polymer streams to a spinneret comprising:

(a) stenciling a pattern in at least one first plate such that the first plate has edges which define a substantially regular two-dimensional geometric shape, a substantially planar upstream surface, a substantially planar downstream surface and at least one flow distribution pattern stenciled therein by cutting through said first plate, said flow distribution pattern connecting said upstream surface with said downstream surface; and (b) then stacking the first plate sealingly adjacent to a second plate which has edges which define a substantially regular two-dimensional geometric shape, a substantially planar upstream surface and a substantially planar downstream surface, said second plate having cut-through holes connecting said upstream surface with said downstream surface to form at least one flow-through channel to allow fluid flow through said first plate and otherwise being substantially solid with solid portions where said first plate is cut through to accomplish fluid flow in a direction transverse to the flow in said flow-through channel, said liquid polymer streams flowing as discrete streams through said flow distribution plate sets to said spinneret.

2. The method of claim 1 wherein said stenciling is by electro-discharge machining.

3. The method of claim 1 wherein said stenciling is by etching the first plate all the way through.

4. The method of claim 1 wherein said stenciling is by machining.

* * * * *